US007364238B2

(12) United States Patent
Higgs et al.

(10) Patent No.: US 7,364,238 B2
(45) Date of Patent: Apr. 29, 2008

(54) ARTICLE OF FURNITURE

(75) Inventors: Steve Higgs, Turrella (AU); David Russell King, Annandale (AU)

(73) Assignee: King Furniture (Australia) Pty Ltd., Turrella (AU)

( * ) Notice: Subject to any disclaimer, the term of this patent is extended or adjusted under 35 U.S.C. 154(b) by 72 days.

(21) Appl. No.: 10/567,859

(22) PCT Filed: May 5, 2004

(86) PCT No.: PCT/AU2004/000582

§ 371 (c)(1),
(2), (4) Date: Feb. 10, 2006

(87) PCT Pub. No.: WO2005/013771

PCT Pub. Date: Feb. 17, 2005

(65) Prior Publication Data

US 2006/0284467 A1 Dec. 21, 2006

(30) Foreign Application Priority Data

Aug. 11, 2003 (AU) ..... 2003904257

(51) Int. Cl.
*A47C 7/54* (2006.01)

(52) U.S. Cl. ..... 297/383; 297/411.35; 297/411.41

(58) Field of Classification Search ..... 297/383, 297/411.35, 411.41; 292/252, DIG. 63
See application file for complete search history.

(56) References Cited

U.S. PATENT DOCUMENTS 2,579,921 A * 12/1951 Gibbs ..... 5/18.1
2,702,197 A * 2/1955 Sabatino ..... 280/298
3,328,810 A * 7/1967 Berman ..... 5/17
4,127,966 A * 12/1978 Schmidt ..... 49/141
4,447,920 A * 5/1984 Rosen ..... 5/12.1
4,763,952 A * 8/1988 Gaudreau, Jr. ..... 297/383
5,207,544 A 5/1993 Yamamoto et al.

(Continued)

FOREIGN PATENT DOCUMENTS

DE 29617154 U 12/1996

(Continued)

*Primary Examiner*—Sarah B McPartlin
(74) *Attorney, Agent, or Firm*—Venable LLP; Catherine M. Voorhees

(57) ABSTRACT

An article of furniture (10) includes a base having a front (14) and a rear (16) and a top (18) surface. A backrest assembly (20) has a front edge (22) and a rear edge (24) and is slideably arranged relative to the base (12) in a plane parallel to the top surface of the base to adjust a depth (D) of the base as measured between the front edge of the backrest assembly and the front of the base. Further it includes a locking mechanism having a displacement member (48) movably received in the housing (42), the displacement member being displaceable between a locking orientation and an unlocking orientation, when the displacement member is in its locking orientation the locking member (50) is urged partially out of the aperture (50) in the housing to protrude a predetermined extent through the housing to effect locking and, when the displacement member is in its unlocking orientation, the locking member is free to be at least partially withdrawn in the housing to effect unlocking.

22 Claims, 3 Drawing Sheets

U.S. PATENT DOCUMENTS

| | | | | |
|---|---|---|---|---|
| 5,518,335 | A | 5/1996 | Dobbins | |
| 5,775,776 | A * | 7/1998 | Schooler et al. | 297/375 |
| 5,902,013 | A * | 5/1999 | Hong | 297/383 |
| 6,425,273 | B1 * | 7/2002 | Kim et al. | 70/224 |
| 7,222,920 | B1 * | 5/2007 | Washington | 297/383 |

FOREIGN PATENT DOCUMENTS

| | | | |
|---|---|---|---|
| DE | 20116300 | U | 2/2002 |
| EP | 1057725 | A | 12/2000 |
| WO | WO 98/09552 | | 3/1998 |

* cited by examiner

ARTICLE OF FURNITURE

CROSS-REFERENCE TO RELATED PATENT APPLICATIONS

This application is a national phase application under 35 U.S.C. §371 of International Application No. PCT/AU2004/000582, filed on May 5, 2004, which claims the benefit of Australian Provisional Patent Application No. 2003904257, filed on Aug. 11, 2003, the disclosures of which are incorporated herein by reference in their entirety.

FIELD FOR THE INVENTION

This invention relates to an article of furniture. More particularly, the invention relates to an adjustable article of furniture.

BACKGROUND TO THE INVENTION

Various reclining-types of armchairs are known which involve a pivoting backrest and an extendible footrest. However, a disadvantage of this arrangement is the space required for such an article of furniture, when in its reclining position.

In addition, such articles of furniture also have complicated manipulating mechanisms to cause the article of furniture to be placed in a reclining position and to be returned to an upright position. The complicated design of the manipulating mechanism renders it prone to failure.

The Applicant is aware of an article of furniture where a backrest pivots to facilitate greater depth of a base of the article of furniture. However, a disadvantage of this arrangement is that, once again, a large amount of space is necessary to pivot the backrest. Also, the backrest is only movable between two positions.

SUMMARY OF THE INVENTION

According to a first aspect of the invention, there is provided an article of furniture which includes:

a base having a front and a rear and a top surface; and a backrest assembly having a front edge and a rear edge and slideably arranged relative to the base in a plane parallel to the top surface of the base to adjust a depth of the base as measured between the front edge of the backrest assembly and the front of the base.

The article of furniture may include a carrier arrangement interposed between the base and the backrest assembly for facilitating sliding displacement of the backrest assembly relative to the base. The carrier arrangement may include a locking mechanism for locking the backrest in a first position at which the depth of the base has a minimum length dimension, a second position at which the depth of the base has a maximum length dimension and at least certain positions between the first position and the second position.

The backrest assembly may comprise a backrest member and at least one armrest extending at an angle from the backrest member. The backrest member may define the front edge and the rear edge of the backrest assembly. Preferably, the backrest assembly includes two armrests, one at each end of the backrest member. Typically, the armrests may extend at right angles to the backrest member.

The carrier arrangement may include a pair of rails, one rail being arranged beneath each armrest of the backrest assembly. A runner may be displaceably arranged on each rail, each runner being secured to an underside of its associated armrest.

The article of furniture may include a locking mechanism for locking each runner and its associated rail relative to each other. The locking mechanism may include a concealed operating member to impart an attractive appearance to the finished article of furniture.

The rails may be arranged in a concealed position on the base with the runners being carried on a lower side of each of the armrests so that, when the backrest assembly is at either of its limits of movement, the rails remain concealed beneath the armrests.

When the backrest assembly is in its first position relative to the base, the rear edge of the backrest member may be substantially in register with the rear of the base. When the backrest assembly is in its second position relative to the base, the rear edge of the backrest member may overhang the rear of the base.

In a preferred form of the invention, the article of furniture is in the form of a sofa. However, it will be appreciated that the invention could apply equally to other seating arrangements such as, for example, a chair.

According to a second aspect of the invention, there is provided a locking mechanism which includes:

a tubular housing defining an aperture in a peripheral wall;

a locking member receivable in the aperture, the locking member being displaceable between a first position in which it protrudes through the aperture and a second position in which it is at least partially withdrawn into the aperture; and a displacement member movably received in the housing, the displacement member being displaceable between a locking orientation and an unlocking orientation, when the displacement member is in its locking orientation the locking member is urged partially out of the aperture in the housing to protrude a predetermined extent through the housing to effect locking and, when the displacement member is in its unlocking orientation, the locking member is free to be at least partially withdrawn into the housing to effect unlocking.

In a first embodiment of the invention, the locking mechanism may include an urging means for urging the displacement member to its locking orientation. The urging means may effect linear displacement of the displacement member relative to the housing. The urging means may be in the form of a coil spring acting on the rod.

The locking mechanism may include an operating member which acts on the displacement member for displacing the displacement member, relative to the housing, between its locking orientation and its unlocking orientation.

The displacement member may be in the form of a rod received in a passage of the housing.

In the first embodiment of the invention, the rod may have a notch defiling a ramped surface formed proximate the end of the rod received in the housing, the notch being aligned with the aperture in the wall of the housing. The ramped surface may bear against the locking member and retain the locking member in register with the. aperture in the body.

In a second embodiment of the invention, the rod may have an eccentrically arranged stepped region, of smaller diameter than a remainder of the rod, defined at or proximate an end of the rod received in the housing, the stepped region defining a first zone which is shallower than an opposed, second zone.

When the rod is in its locking orientation the locking member is in the first zone and protrudes partially through the aperture to effect locking. Conversely, when the rod is in its unlocking orientation, the second zone is in register with the locking member and the locking member can be received in the second zone to effect unlocking.

The locking member may be in the form of a ball.

The locking mechanism, as described above, may be used with the article of furniture, also as described above. However, it will be appreciated that the locking mechanism could have other applications.

BRIEF DESCRIPTION OF THE DRAWINGS

The invention is now described, by way of example, with reference to the accompanying diagrammatic drawings in which.

DETAILED DESCRIPTION OF THE PREFERRED EMBODIMENTS

Figure 1:
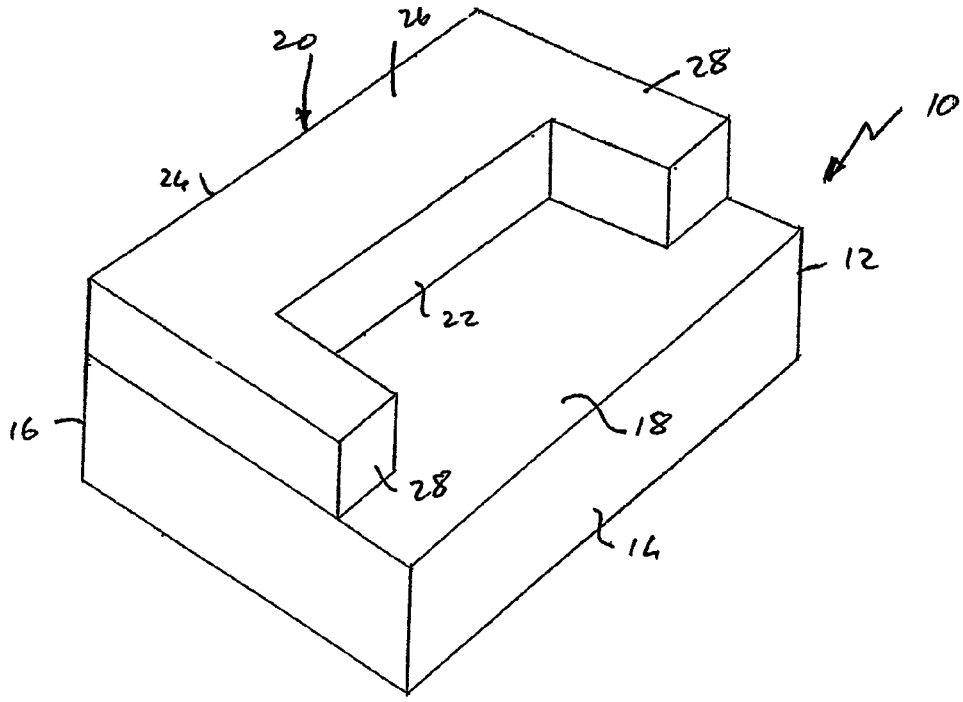
FIG. 1 shows a three dimensional, schematic view of an article of furniture, in accordance with an embodiment of a first aspect of the invention, with a backrest assembly of the article of furniture in a first position.
Figure 2:
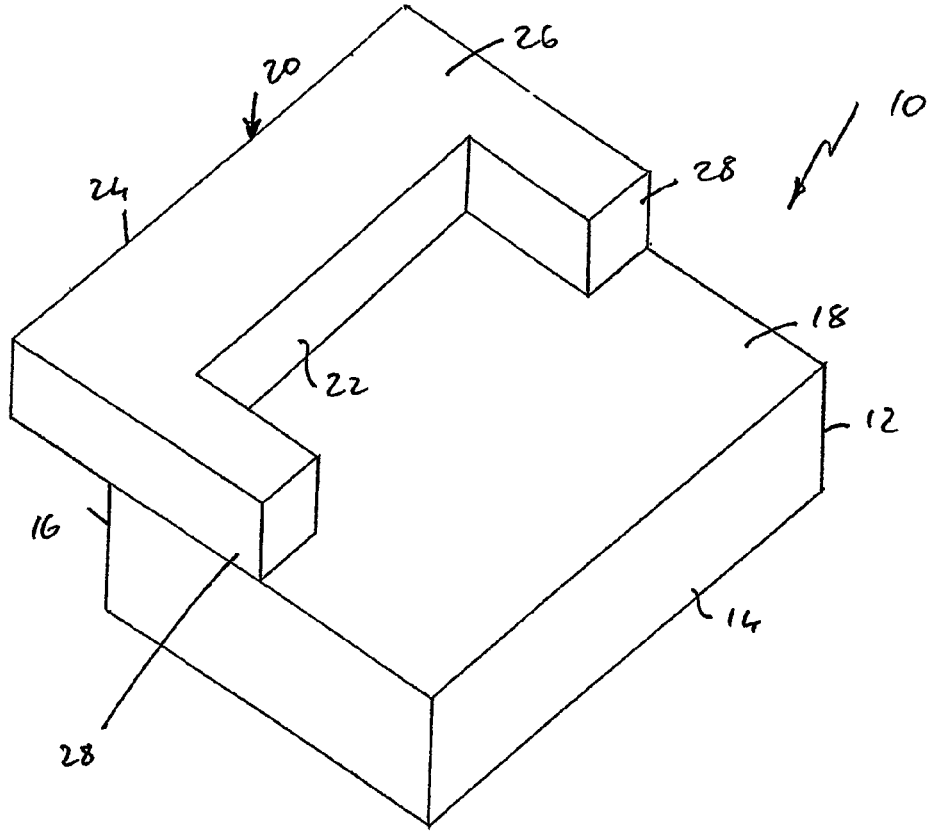
FIG. 2 shows a three dimensional, schematic view of the article of furniture with the backrest assembly in a second position.
Figure 3:
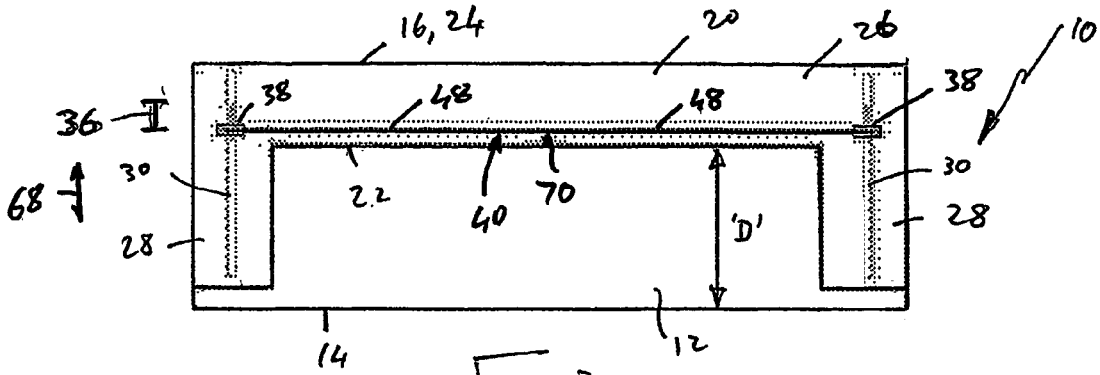
FIG. 3 shows a schematic plan view of the article of furniture of FIGS. 1 and 2 illustrating a locking mechanism in accordance with an embodiment of another aspect of the invention.

In FIGS. 1 to 3 of the drawings, reference numeral 10 generally designates an article of furniture, in the form of a sofa, in accordance with an embodiment of a first aspect of the invention.

The sofa 10 includes abase 12 having a front 14, a rear 16 and a top surface 18.

A backrest assembly 20 is slideably arranged relative to the base 12 in a plane parallel to the top surface 18 of the base 12 to adjust a depth 'D' (FIG. 3) of the base. The backrest assembly 20 defines a front edge 22 and a back edge 24. The depth 'D' of the base 12 is measured between the front 14 of the base 12 and the front edge 22 of the backrest assembly 20.

The backrest assembly 20 includes a backrest member 26 and a pair of armrests 28. The armrests 28 are arranged at opposed ends of the backrest member 26.

To impart an attractive appearance to the sofa 10, the backrest member 26 of the backrest assembly 20 has a width greater than its height.

The sofa 10 includes a carrier arrangement for slideably supporting the backrest assembly 20 on the base 12. The carrier arrangement comprises a pair of rails 30, one arranged beneath each armrest 28. The rails 30 are secured via struts 32 (FIGS. 4 and 5) to the base 12.

Each armrest 28 carries, on its lower surface, a runner 34 which is held slideably captive on its associated rail 30.

It is to be noted that the degree of movement of the backrest assembly 20 relative to the base 12 illustrated in FIGS. 1 and 2 of the drawings is greatly exaggerated merely to illustrate the operation of the sofa 10. In practice, the degree of movement is substantially more limited and the extent of movement of the backrest 20 relative to the base 12 is shown at 36 in FIG. 3 of the drawings.

The sofa 10 includes a locking mechanism 40 comprising a lock 38 associated with each runner 34. Each lock 38 includes a tubular housing 42 having a closed end 44 and an open end 46. A displacement member, or rod, 48 extends into the interior of the housing 42 through the open end 46. A locking member in the form of a ball bearing or ball 50 is held captive in a notch 52 (FIGS. 4 and 5) or a stepped region 72 (FIGS. 6 and 7) defined in that end of the rod 48 received in the housing 42, the notch 52 or stepped region 72 being bounded by a peripheral wall 54 of the housing 42.

Figure 4:
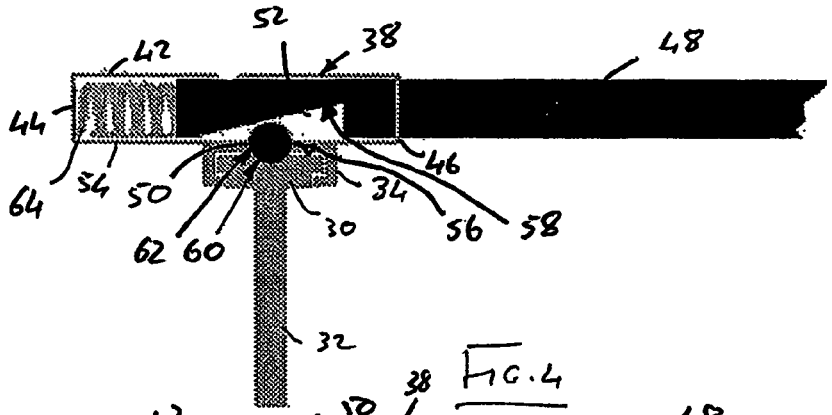
FIG. 4 shows a schematic side view of a first embodiment of the locking mechanism, in accordance with the embodiment of the other aspect of the invention, in its locking orientation.
Figure 6:
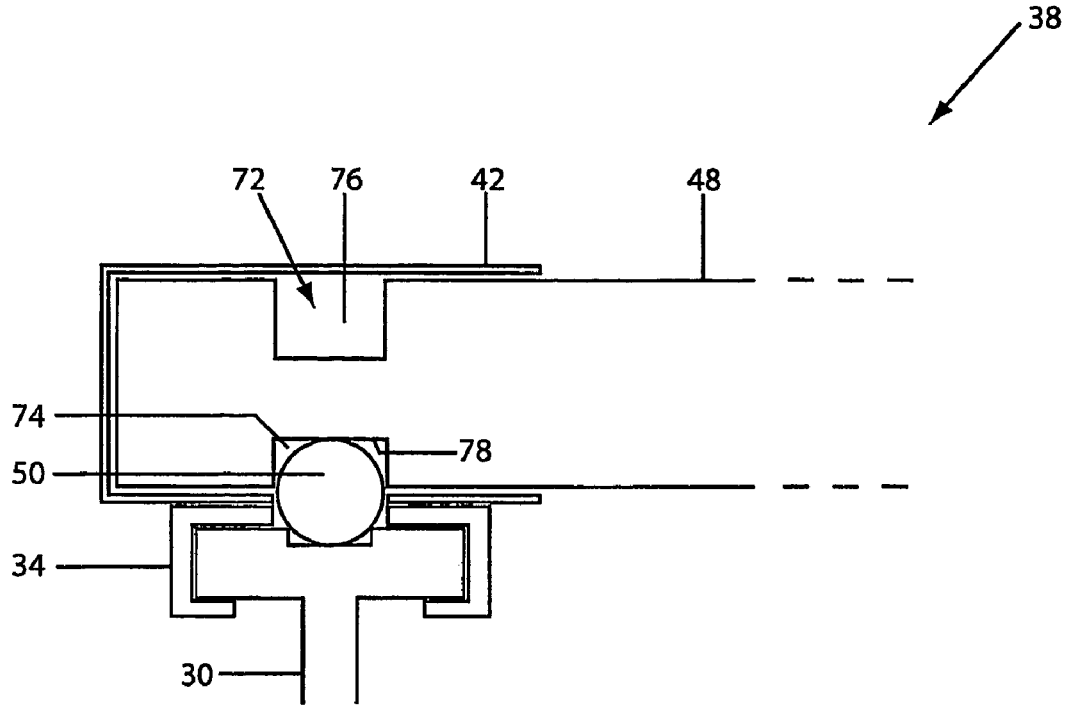
FIG. 6 shows a schematic side view of a second embodiment of the locking mechanism, in accordance with the embodiment of the other aspect of the invention, in its locking orientation.

The peripheral wall 54 of the housing 42 defines an opening 56 in register with the notch 52 or stepped region 72 through which the ball 50 protrudes at least partially when the lock 38 is in its locking orientation as shown in FIGS. 4 and 6 of the drawings.

Figure 5:
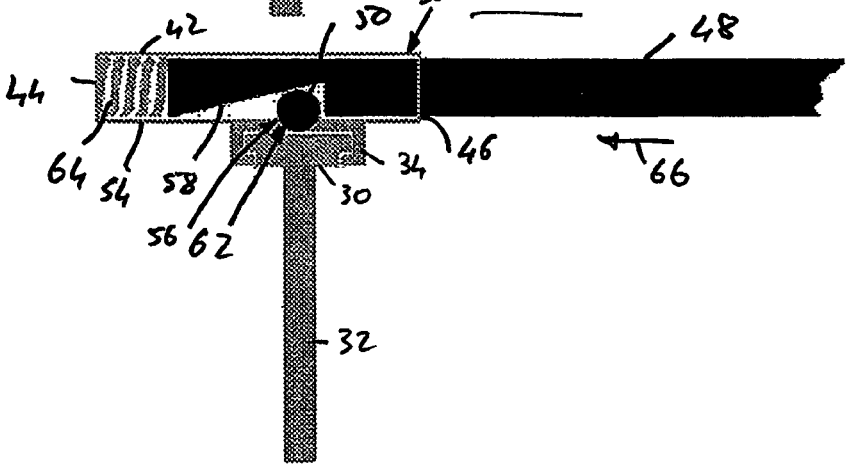
FIG. 5 shows a schematic side view of the embodiment of the locking mechanism shown in FIG. 4 in its unlocked orientation.

A first embodiment of a locking mechanism in accordance with the invention is shown in FIGS. 4 and 5 of the drawings. The notch 52 in the end of the rod 48 is defined by a ramped surface 58 in the end of the rod 48.

When the lock 38 is in its locking orientation, as shown in FIG. 4 of the drawings, a lower part (when viewed in the orientation of FIG. 4 of the drawings) of the ramp 58 bears on the ball 50, forcing it downwardly into seating engagement with a recess 60 defined in a top surface of the rail 30. To effect locking, the ball 50 passes through an opening 62 defined in the runner 34. It will also be appreciated that a plurality of recesses 60 are defined at longitudinally spaced intervals in the top surface of the rail 30 within the limits of movement, as illustrated at 36, of the backrest assembly 20 relative to the base 12 to provide a range of positions at which the backrest assembly 20 can be locked relative to the base 12.

An urging means in the form of a coil spring 64 is interposed between the end 44 of the housing 42 and the end of the rod 48 received in the housing 42 to urge the rod 48 into its locked orientation as shown in FIG. 4 of the drawings.

When the lock 38 is moved to an unlocked orientation, the rod 48 is urged in the direction of arrow 66 (FIG. 5) against the action of the coil spring 64 so that a higher part of the ramp 58 is in register with the ball 50. The ball 50 is then free to be withdrawn out of the recess 60 in the top surface of the rail 30. This, in turn, frees the runner 34 to slide relative to the rail 30 in the direction of arrows 68 (FIG. 3).

Figure 7:
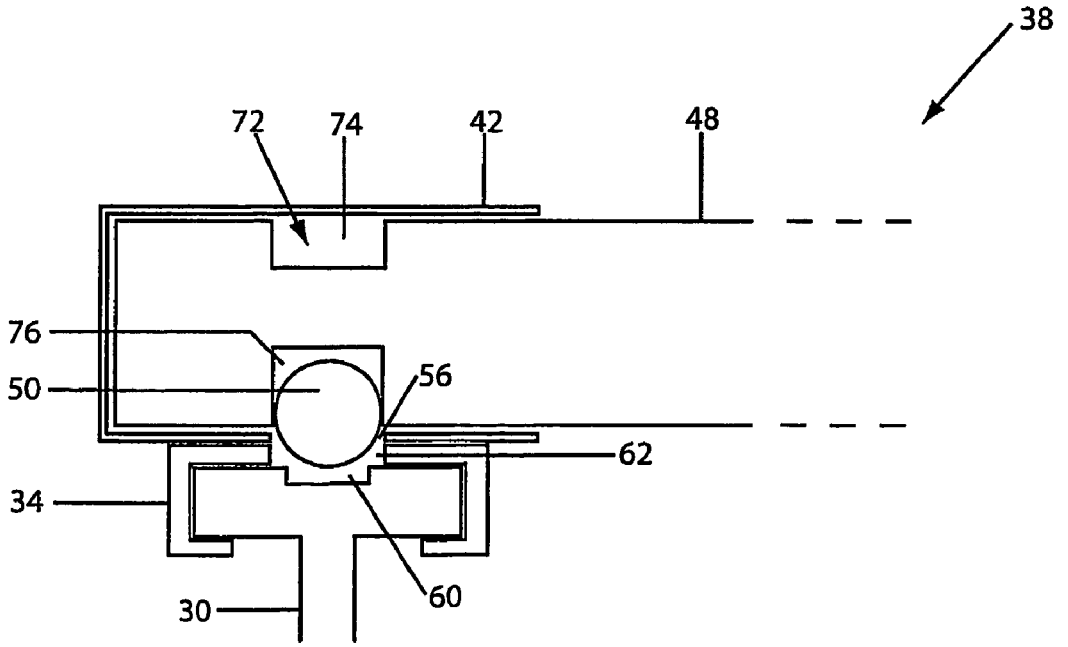
FIG. 7 shows a schematic side view of the embodiment of the locking mechanism shown in FIG. 6 in its unlocked orientation.

A second embodiment of the locking mechanism in accordance with the invention is shown in FIGS. 6 and 7 of the drawings. With reference to the previous drawings, like reference numerals refer to like parts unless otherwise specified. The stepped region 72 in the end of the rod 48 received in the housing 48 is eccentrically arranged and has a smaller diameter than the remainder of the rod 48. The stepped region 72 defines a first zone 74, having a locking surface 78, which is shallower than an opposed second zone 76.

When the lock 38 is in its locking orientation, as shown in FIG. 6 of the drawings, the first zone 74 is in register with the ball 50 and the locking surface 78 bears on the ball 50, forcing it downwardly into seating engagement with the desired recess 60 defined in the top surface of the rail 30. To effect locking, the ball 50 passes through the opening 62 defined in the runner 34.

When the rod 48 is rotated so that the lock 38 is moved to an unlocked orientation as shown in FIG. 7, the second zone 76 comes into register with the ball 50. As this zone 76 is deeper than the zone 74, the ball 50 is free to be withdrawn out of the recess 60 in the top surface of the rail 30 and received in the second zone 76 of the stepped region 72. This, in turn, frees the runner 34 to slide relative to the rail 30 in the direction of the arrows 68 (FIG. 3).

The locking mechanism 40 includes an operating member 70 (FIG. 3) which is arranged in a concealed position beneath the backrest 26 of the backrest assembly 20 and which is operated by an occupant to effect sliding movement of the backrest assembly 20 relative to the base 12 of the sofa 10 and also to lock the backrest assembly 20 in the desired position relative to the base 12.

In use, to effect sliding movement of the backrest assembly 20 relative to the base 12, the operating member 70 of the locking mechanism 40 is operated to move the locks 38 to the unlocked orientation as shown in FIG. 5 or FIG. 7 of the drawings. Because the ball 50 of each lock 38 is no longer constrained by the ramped surface of its associated notch 52 or the first zone 74 of the stepped region 72 and, because less than half the circumference of the ball 50 is received in the recess 60 of the rail 30, when pressure is applied to the backrest assembly 20 in the direction in which it is desired to move the assembly 20, the ball 50 clears the recess 60 of the rail 30. The backrest assembly 20 is then able to be slid in the desired direction either to increase or decrease the depth 'D' of the base 12 as measured between the front 14 of the base 12 and the front edge 22 of the backrest assembly 20. For example, if the occupant of the sofa 10 wishes to recline, the backrest assembly 20, if not already at its rearmost limit of movement, is slid to that position after releasing the locks 38 of the locking mechanism 40. Once at that position, the operating member 70 is released causing the locks 38 to move to their locked orientation retaining the backrest assembly 20 at its rearmost limit of movement relative to the base 12.

Should the occupant of the sofa wish to sit more upright, the operation is reversed. In other words, the operating member 70 is again operated to cause the locks 38 to move to their unlocked orientation. The backrest assembly 20 is slid towards the front of 14 of the base 12. When the backrest assembly 20 is at the limit of its forward travel, the operating member 70 of the locking mechanism 40 is released, once again causing the locks 38 to adopt their locked orientation and retaining the backrest assembly 20 at its forwardmost position relative to the base 12.

It will also be appreciated that the backrest assembly 20 can be locked at any of a number of intermediate positions relative to the base 12 between the forwardmost limit of travel of the backrest assembly 20 and the rearmost limit of travel of the back rest assembly 20.

It is an advantage of the invention that an article of furniture is provided which has an extremely simple mechanism for effecting an increase or decrease in the depth of the base of that article of furniture. No complicated reclining mechanism is required. Also, the footprint of the article of furniture, even with the backrest assembly 20 at its rearmost limit of travel, is not significantly greater than when the backrest assembly 20 is at its forward most limit of travel. Thus, the article of furniture does not use a significantly greater amount of space when being used as a recliner.

In addition, a simplified but efficient locking mechanism 40 is provided which is simple to operate. The Applicant believes that, as a result of the limited number of moving parts of the locking mechanism, it should prove very reliable in operation. The locking mechanism is mounted in a concealed position in the article of furniture and, as a result, does not impair the aesthetics of the article of furniture.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An article of furniture which includes:

a base having a front and a rear and a top surface;

a backrest assembly having a front edge and a rear edge and slideably arranged relative to the base in a plane parallel to the top surface of the base to adjust a depth of the base as measured between the front edge of the backrest assembly and the front of the base; and a carrier arrangement interposed between the base and the backrest assembly for facilitating sliding displacement of the backrest assembly relative to the base; the carrier arrangement includes a locking mechanism acting on the base and the backrest assembly for locking the backrest assembly in a first position at which the depth of the base has a minimum length dimension, a second position at which the depth of the base has a maximum length dimension and at least certain positions between the first position and the second position, the locking mechanism comprising:

a tubular housing defining an aperture in a peripheral wall;

a locking member receivable in the aperture, the locking member being displaceable between a first position in which it protrudes through the aperture and a second position in which it is at least partially withdrawn into the aperture; and a displacement member movably received in the housing, the displacement member being displaceable between a locking orientation and an unlocking orientation so that, when the displacement member is in its locking orientation the locking member is urged partially out of the aperture in the housing to protrude a predetermined extent through the housing to effect locking and, when the displacement member is in its unlocking orientation, the locking member is free to be at least partially withdrawn into the housing to effect unlocking.

2. An article of furniture as claimed in claim 1 in which the backrest assembly includes a backrest member and at least one armrest extending at an angle from the backrest member.

3. An article of furniture as claimed in claim 2 in which the backrest member defines the front edge and the rear edge of the backrest assembly.

4. An article of furniture as claimed in claim 2 in which the backrest assembly includes two armrests.

5. An article of furniture as claimed in claim 4 in which the armrests extend at right angles to the backrest member.

6. An article of furniture as claimed in claim 4 in which the carrier arrangement includes a pair of rails, one rail being arranged beneath each armrest of the backrest assembly.

7. An article of furniture as claimed in claim 6 in which a runner is displaceably arranged on each rail, each runner being secured to an underside of its associated armrest.

8. An article of furniture as claimed in claim 7 in which the carrier mechanism includes multiple locking mechanisms, one locking mechanism being associated with each armrest and each locking mechanism releasably locking the runner of the armrest and the rail on which that runner is arranged relative to each other.

9. An article of furniture as claimed in claim 8 in which each locking mechanism includes a concealed operating member.

10. An article of furniture as claimed in claim 7 in which the rails are arranged in a concealed position on the base with the runners being carried on a lower side of each of the armrests so that, when the backrest assembly is at either of its limits of movement, the rails are concealed beneath the armrests.

11. An article of furniture as claimed in claim 2 in which the rear edge of the backrest member is substantially in alignment with the rear of the base when the backrest assembly is in its first position relative to the base.

12. An article of furniture as claimed in claim 2 in which the rear edge of the backrest member overhangs the rear of the base when the backrest assembly is in its second position relative to the base.

13. An article of furniture as claimed in claim 1 which is in the form of a sofa.

14. An article of furniture as claimed in claim 1 in which the locking mechanism includes an urging element for urging the displacement member to its locking orientation.

15. An article of furniture as claimed in claim 14 in which the urging element effects linear displacement of the displacement member relative to the housing.

16. An article of furniture as claimed in claim 14 in which the urging means is in the form of a coil spring acting on the rod.

17. An article of furniture as claimed in claim 1 which includes an operating member which acts on the displacement member for displacing the displacement member, relative to the housing, between its locking orientation and its unlocking orientation.

18. An article of furniture as claimed in claim 1 in which the displacement member is in the form of a rod received in a passage of the housing.

19. An article of furniture as claimed in claim 18 in which the rod has a notch defining a ramped surface formed proximate an end of the rod received in the housing.

20. An article of furniture as claimed in claim 19 in which the ramped surface bears against the locking member and retains the locking member in register with the aperture in the body member.

21. An article of furniture as claimed in claim 18 in which the rod has an eccentrically arranged stepped region, of smaller diameter than a remainder of the rod, defined at or proximate an end of the rod received in the housing, the stepped region defining a first zone which is shallower than an opposed, second zone.

22. An article of furniture as claimed in claim 1 in which the locking member is in the form of a ball.

* * * * *